US010471400B2

(12) United States Patent
Yueh

(10) Patent No.: US 10,471,400 B2
(45) Date of Patent: Nov. 12, 2019

(54) PORTABLE BUBBLE WATER BOTTLE

(71) Applicant: Chao-Yu Yueh, Taipei (TW)

(72) Inventor: Chao-Yu Yueh, Taipei (TW)

( * ) Notice: Subject to any disclaimer, the term of this patent is extended or adjusted under 35 U.S.C. 154(b) by 266 days.

(21) Appl. No.: 15/668,923

(22) Filed: Aug. 4, 2017

(65) Prior Publication Data

US 2018/0296990 A1 Oct. 18, 2018

(30) Foreign Application Priority Data

Apr. 14, 2017 (TW) ..... 106205218 U

(51) Int. Cl.

| | |
|---|---|
| ***B01F 3/04*** | (2006.01) |
| ***B65D 81/32*** | (2006.01) |
| ***B67D 1/04*** | (2006.01) |
| ***A45F 3/16*** | (2006.01) |
| ***B65D 43/02*** | (2006.01) |
| ***B65D 51/28*** | (2006.01) |

(52) U.S. Cl.

CPC ..... *B01F 3/04801* (2013.01); *A45F 3/16* (2013.01); *B65D 43/02* (2013.01); *B65D 51/28* (2013.01); *B65D 81/3216* (2013.01); *B65D 81/3222* (2013.01); *B67D 1/04* (2013.01); *B01F 2003/049* (2013.01)

(58) Field of Classification Search

CPC .. A45F 3/16; B01F 3/04801; B01F 2003/049; B65D 43/02; B65D 51/28; B65D 81/3216; B65D 81/3222; B67D 1/04

USPC ..... 261/64.1, 75, 119.1, DIG. 7

See application file for complete search history.

(56) References Cited

U.S. PATENT DOCUMENTS

| | | | | | |
|---|---|---|---|---|---|
| 2,345,081 | A * | 3/1944 | Ward | B67D 1/0418 | 141/15 |
| 2,805,846 | A * | 9/1957 | Dewan | B01F 3/04801 | 137/850 |
| 3,613,954 | A * | 10/1971 | Bayne | B67D 1/0412 | 222/61 |
| 4,399,744 | A * | 8/1983 | Ogden | A23L 2/54 | 261/DIG. 27 |
| 4,457,877 | A * | 7/1984 | Love | A23L 2/54 | 141/17 |
| 4,867,209 | A * | 9/1989 | Santoiemmo | B01F 3/04801 | 141/19 |
| 5,460,846 | A * | 10/1995 | Stumphauzer | A23L 2/54 | 261/DIG. 7 |
| 5,531,254 | A * | 7/1996 | Rosenbach | A23L 2/54 | 141/113 |
| 2011/0115103 | A1* | 5/2011 | Tatera | B01F 3/04801 | 261/35 |
| 2013/0113124 | A1* | 5/2013 | Hoffmann | A23L 2/54 | 261/65 |

* cited by examiner

*Primary Examiner* — Charles S Bushey

(74) *Attorney, Agent, or Firm* — McClure, Qualey & Rodack, LLP

(57) ABSTRACT

A portable bubble water bottle of the present application includes a first space, a second space, a one-way gas valve and a gas bottle. The second space is located in the first space along the first projection direction. The one-way gas valve connects the first space with the second space. The gas bottle is located in the second space, and has a gas outlet connected to the one-way gas valve.

5 Claims, 5 Drawing Sheets

PORTABLE BUBBLE WATER BOTTLE

CROSS REFERENCE TO RELATED APPLICATIONS

This Non-provisional application claims priority under 35 U.S.C. § 119(a) on Patent Application No. 106205218 filed in Taiwan, Republic of China on Apr. 14, 2017, the entire contents of which are hereby incorporated by reference.

BACKGROUND OF THE INVENTION

Field of the Invention

This invention relates to a bubble water bottle, in particular, to a portable bubble water bottle.

Descriptions of the Related Art

As the advantages of drinking bubble water are raised, drinking bubble water is increasingly popular among the public, apart from purchasing bubble water, the practitioner also has developed the bubble water machine to allow the public to make bubble water at home.

Refer to FIG. 1, the prior bubble water machine 40 mainly consists of a cabinet 41, a gas bottle 42, a cup 43 and a gas-guide tube 44. The gas bottle 42 is filled with carbon dioxide, and installed at one side of the cabinet 41. The cup 43 can be placed at another side of the cabinet 41, and the cup 43 is connected to the gas bottle 42 by the gas-guide tube 44. The gas-guide tube 44 is dipped into the cup 43 to mix carbon dioxide gas in the gas bottle 42 with water in the cup 43 and thus to make bubble water. At last, the cup 43 is taken out of the cabinet 41, and then the user can drink the bubble water in the cup 43 directly or pour into other container for drinking.

Due to the bubble water machine will take up a fixed space, some practitioners also launch the portable bubble water bottle. Refer to FIG. 2, the prior bubble water bottle 50 mainly consists of a cover 51, a cup 52, a gas-guide tube 53 and a gas bottle 54. The cover 51 is connected to the cup 52, besides, the gas-guide tube 53 extends into the cup 52 via the cover 51. The gas bottle 54 is connected to one end of the gas-guide tube 53 exposed outside the cover 51 to mix carbon dioxide gas in the gas bottle 54 with water in the cup 52 and thus to make bubble water.

However, the gas bottle is exposed outside while using portable bubble water bottle. If the user collides against the gas bottle by accident while using the bubble water bottle, it may lead to the detachment of connection between the gas bottle and gas-guide tube. The gas bottle is filled with high pressure gas, so that the gas bottle may be jetted to some place with high speed when the gas bottle is detached from the gas-guide tube, thus causing danger. For this reason, it is one of the important subjects to provide a portable gas bottle that may avoid exposed gas bottle, so as to take convenience and safety into consideration.

SUMMARY OF THE INVENTION

In view of the foregoing, the present invention is to provide a portable bubble water bottle that can avoid exposed gas bottle and improve the safety of use.

To reach the above purpose, a portable bubble water bottle is introduced including a first closed sidewall, a first bottom, a second closed sidewall, a second bottom and a one-way gas valve. The first closed sidewall has a first end and a second end, and the first end has a first opening. The first bottom extends to a second end of the first closed sidewall, and has a second opening. The second closed sidewall has a third end and a fourth end, besides, the third end is connected to the periphery of the second opening of the first bottom, and extends towards the first opening. The second bottom extends to the fourth end of the second closed sidewall. The first closed sidewall, the first bottom, the second closed sidewall and the second bottom form the first space, while the second closed sidewall and the second bottom form the second space. The one-way gas valve is set at the second bottom, and connects the first space with the second space.

In one embodiment of the present invention, the portable bubble water bottle further includes a cover, which is connected to the first end of the first closed sidewall to seal the first space.

In one embodiment of the present invention, the portable bubble water bottle further includes a pedestal, which is connected to the third end of the second closed sidewall to seal the second space.

In one embodiment of the present invention, the portable bubble water bottle further includes a gas bottle, which is connected to a limited component of the pedestal and is located at the second space; besides, a gas outlet of gas bottle is connected to the one-way gas valve.

In one embodiment of the present invention, the volume of the second space is smaller than that of the first space.

To reach the above purpose, a portable bubble water bottle is introduced including a first space, a second space, a one-way gas valve and a gas bottle. The second space is located in the first space along the first projection direction. The one-way gas valve connects the first space with the second space. The gas bottle is located in the second space, and has a gas outlet connected to the one-way gas valve.

In one embodiment of the present invention, the second projection direction of the second space is located in the first space, besides, the first projection direction has 90 degrees from the second projection direction.

In one embodiment of the present invention, the first projection direction of the gas bottle is located in the first space, besides, the second projection direction is located in the first space.

To sum up, a portable bubble water bottle of the present invention can set the gas bottle into the body of the bubble water bottle to protect the gas bottle by means of the entirety of the bubble water bottle and avoid the use method of exposed gas bottle. In this way, it can avoid the danger caused by gas bottle drop from collision while using.

The detailed technology and preferred embodiments implemented for the subject invention are described in the following paragraphs accompanying the appended drawings for people skilled in this field to well appreciate the features of the claimed invention.

BRIEF DESCRIPTION OF THE DRAWINGS

The parts in the drawings are not necessarily drawn to scale, the emphasis instead being placed upon clearly illustrating the principles of at least one embodiment. In the drawings, like reference numerals designate corresponding parts throughout the various diagrams, and all the diagrams are schematic.

DESCRIPTION OF THE PREFERRED EMBODIMENT

In the following description, this invention will be explained with reference to embodiments thereof. However, the description of these embodiments is only for purposes of illustration rather than limitation. It should be appreciated that in the following embodiments and attached drawings, elements unrelated to this invention are omitted from depictions; and dimensional relationships among individual elements in the attached drawings are illustrated only for ease of understanding, but not to limit the actual scale.

Figure 1:
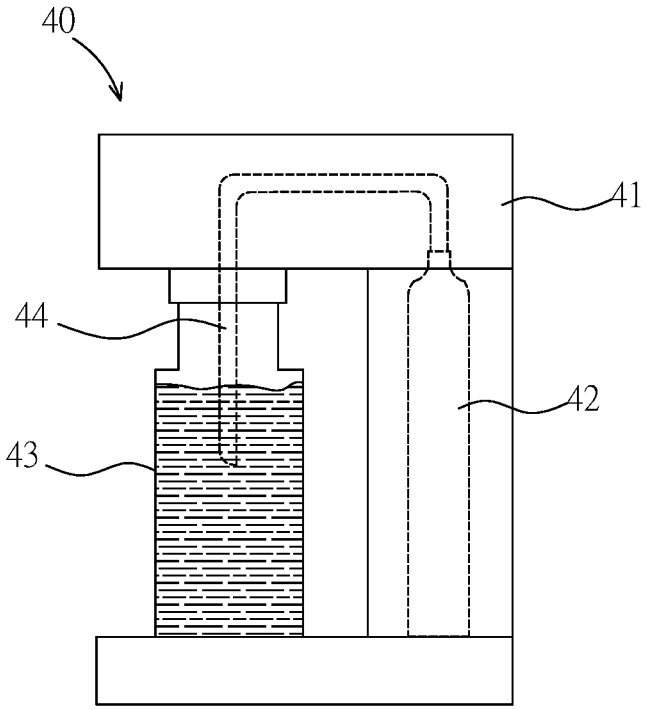
FIG. 1 (PRIOR ART)
FIG. 1 is a schematic diagram showing a prior bubble water machine.
Figure 2:
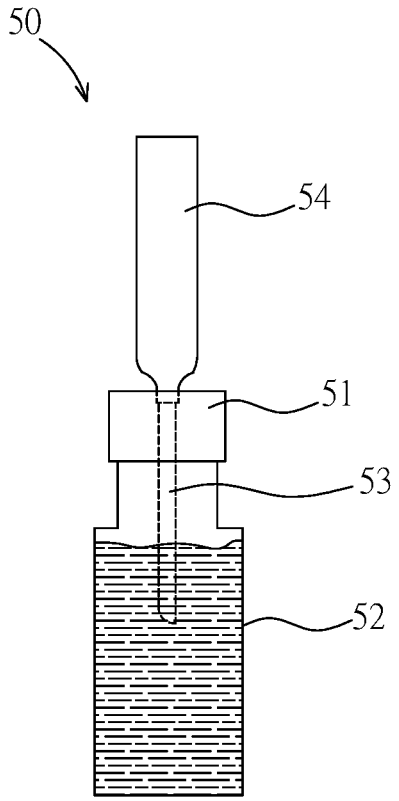
FIG. 2 (PRIOR ART)
FIG. 2 is a schematic diagram showing a prior bubble water bottle.
Figure 3:
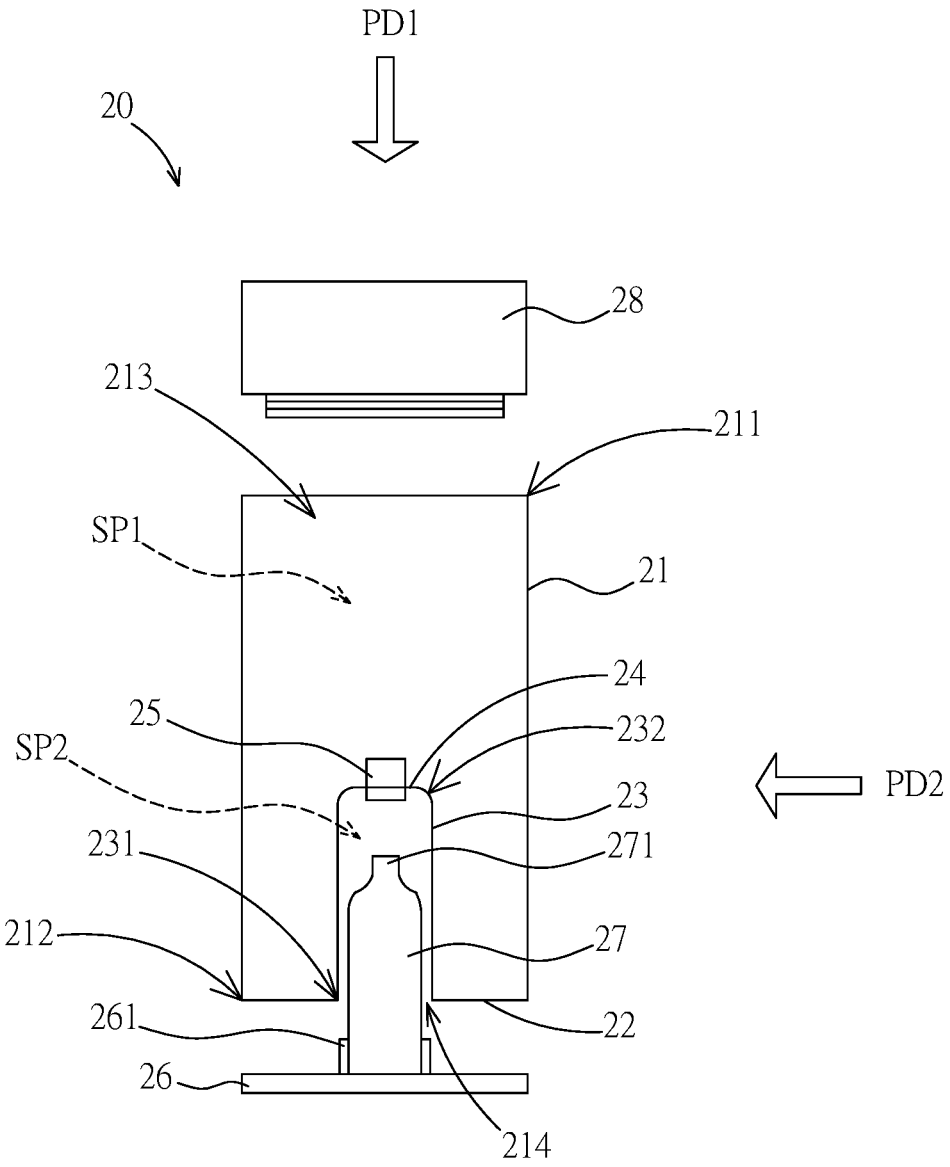
FIG. 3 is a schematic diagram showing a portable bubble water bottle according to a first embodiment of the present invention.

Refer to FIG. 3, a portable bubble water bottle 20 of a first embodiment of the present invention includes a first closed sidewall 21, a first bottom 22, a second closed sidewall 23, a second bottom 24, a one-way gas valve 25, a pedestal 26, a gas bottle 27 and a cover 28. In the embodiment, the closed sidewall presents a tube-like shape.

The first closed sidewall 21 has a first end 211 and a second end 212, and the first end 211 has a first opening 213, which forms by the first closed sidewall 21. The second end 212 is connected to the first bottom 22, which has a second opening 214. In the embodiment, the first bottom 22 is set along the periphery of the second end 212.

The second closed sidewall 23 has a third end 231 and a fourth end 232. The third end 231 is connected to the periphery of the second opening 214 of the first bottom 22, besides, the second closed sidewall 23 is set in an extending way from the second opening 214 towards the first opening 213. The second bottom 24 is connected to the fourth end 232 of the second closed sidewall 23.

In the embodiment, the first closed sidewall 21, the first bottom 22, the second closed sidewall 23 and the second bottom 24 form a first space SP1, while the second closed sidewall 23 and the second bottom 24 form a second space SP2. Besides, in the embodiment, the volume of the second space SP2 is smaller than that of the first space SP1.

Figure 4A:
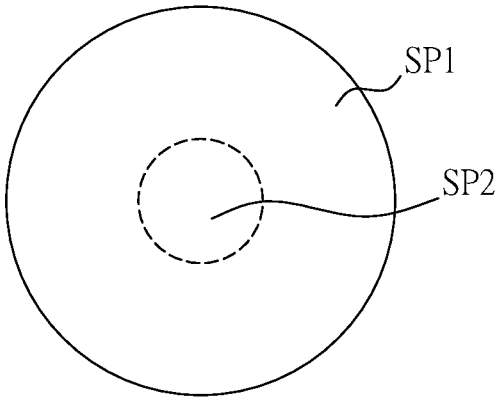
FIG. 4A and FIG. 4B are the projection relationship showing the first space and the second space of portable bubble water bottle of the first embodiment.
Figure 4B:
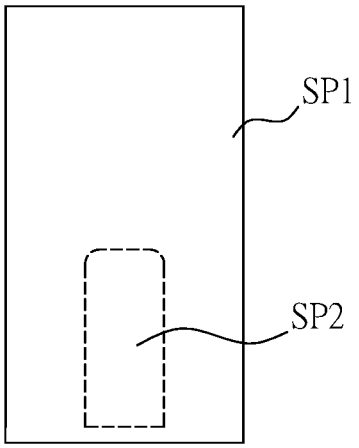

As shown in FIG. 4A, the second space SP2 is located in the first space SP1 along a first projection direction PD1. In the embodiment, the first projection direction PD1 refers to the projection from the first opening 213 towards the second opening 214. As shown in FIG. 4B, the second space SP2 is located in the first space SP1 along a second projection direction PD2. In the embodiment, the second projection direction PD2 has 90 degrees from the first projection direction PD1, and projects towards the second closed sidewall 23 from the first closed sidewall 21.

As shown in FIG. 3, the one-way gas valve 25 is set at the second bottom 24, and connects the first space SP1 with the second space SP2. In the embodiment, the one-way gas valve 25 leads to the first space SP1 from the second space SP2.

The pedestal 26 is connected to the third end 231 of the second closed sidewall 23 to seal the second space SP2. The pedestal 26 has a limited component 261, which is set in an extending way from the pedestal 26 towards the second space SP2 to seal the second space SP2. The limited component 261 is to fix the position of the gas bottle 27 in the second space SP2, and to avoid displacement of the gas bottle 27 in the second space SP2 after the pedestal 26 is connected to the third end 231 of the second closed sidewall 23 through clamping, locking or close fit, and the close fit can be done through rubber or other materials with great force of friction.

The one-way gas valve 25 located in the second space SP2 is connected to a gas outlet 271 of gas bottle 27 to allow the gas in the gas bottle 27 to flow into the first space SP1. In the embodiment, the gas bottle 27 is filled with carbon dioxide.

The cover 28 is connected to the first end 211 of the first closed sidewall 21. In the embodiment, the cover 28 is connected to the first closed sidewall 21 in a way of screwing to seal the first space SP1.

In the actual use, the first space SP1 is generally to contain water, juice, tea-based drink, alcoholic beverage and other fluid. After the cover 28 is connected to the first closed sidewall 21 to seal the first space SP1, the bubble beverage is produced when carbon dioxide in gas bottle 27 enters the first space SP1 via the one-way gas valve 25. The setting of the one-way gas valve 25 may also prevent the fluid in the first space SP1 from flowing into the second space SP2, e.g. install a check valve at the gas outlet of the gas valve to avoid the fluid to flow into the second space SP2.

In the above embodiment, the one-way gas valve 25 is a direct pressure type, while one-way gas valve 25 may also be provided with a gas regulation unit (not shown in the FIG.) to release gas in the gas bottle 27 after pressure reduction, or only to allow to pass gas of certain flow rate by action of the gas regulation unit each time.

Figure 5:
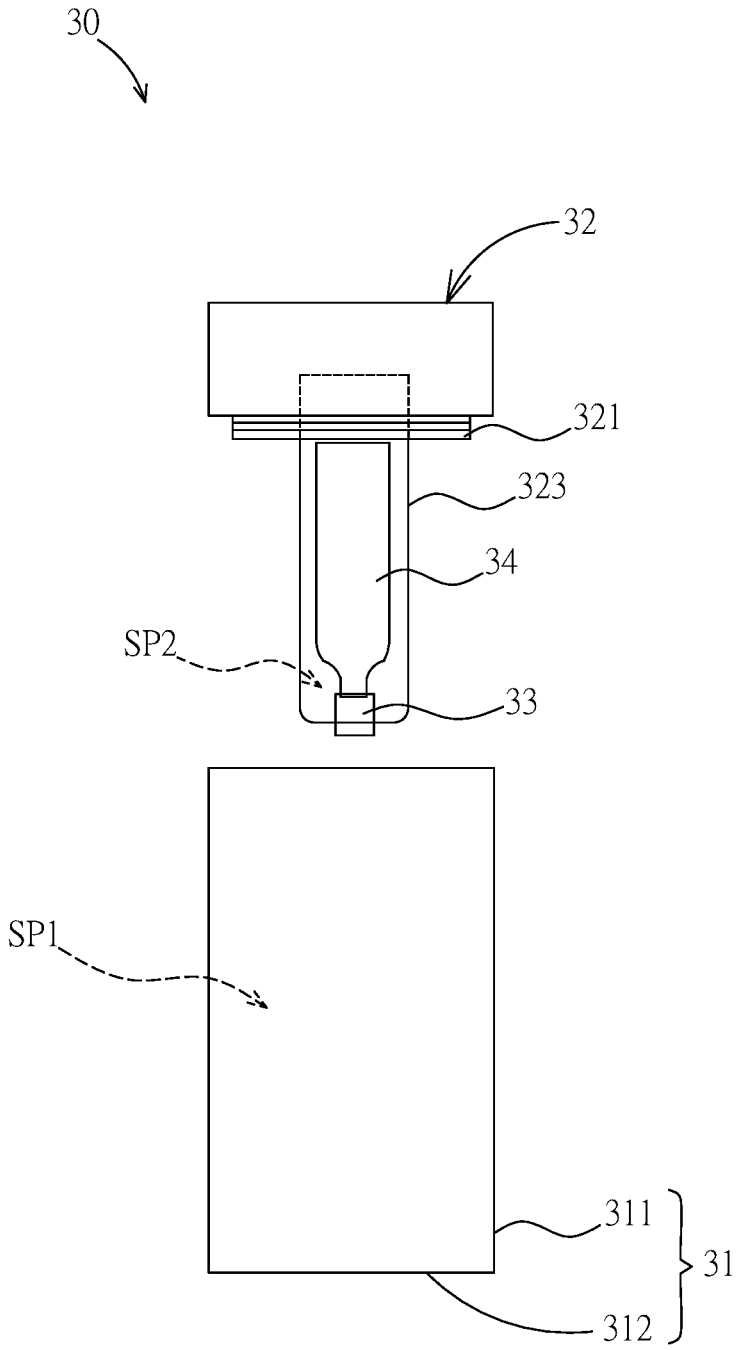
FIG. 5 is a schematic diagram showing a portable bubble water bottle of a second embodiment of the present invention.

Refer to FIG. 5, a portable bubble water bottle 30 of the second embodiment of the present invention includes a bottle 31, a cover 32 and a one-way gas valve 33. In the bottle 31, a closed sidewall 311 and a bottom 312 form the first space SP1. The first space SP1 is to contain water, juice, tea-based drink, alcoholic beverage and other fluid. The cover 32 has a connecting part 321 and the second space SP2. The connecting part 321 is to connect to the bottle 31 and seal the first space SP1. The second space SP2 is set in an extending way from the center of the connecting part 321 of the cover 32 towards the inside of the first space SP1, in other words, the second space SP2 will be included in the first space SP1 of the bottle 31 after the connecting part 321 of the cover 32 is connected to the bottle 31.

The second space SP2 can form by connecting a sub-cover 323 to a bottom surface of the cover 32. After the sub-cover 323 is demounted from the bottom surface, a gas bottle 34 can be installed in the second space SP2, besides, the gas bottle 34 is connected to the one-way gas valve 33 set at one end of the sub-cover 323, thus to make the gas in the gas bottle 34 flow into the first space SP1 via the one-way gas valve 33 and mix the gas with the fluid.

As mentioned above, in the portable bubble water bottle disclosed in the present invention, the second space is included and contained in the first space of the gas bottle. The first space basically refers to the bottle body composed of the first closed sidewall and the first bottom, therefore, while suing portable bubble water bottle, the gas bottle is included in the bottle body without being exposed outside, this avoids the danger during using the bubble water bottle. With the entire bottle body for protection, it can increase the safety while using bubble water bottle.

The above embodiments merely give the detailed technical contents of the present invention and inventive features thereof, and are not to limit the covered range of the present invention. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A portable bubble water bottle, comprising:

a first closed sidewall having a first end with a first opening and a second end, which is opposite to the first end;

a first bottom extended to the second end of the first closed sidewall, and having a second opening;

a second closed sidewall having a third end and a fourth end, which is opposite to the third end, wherein the third end is connected to the periphery of the second opening of the first bottom, and extended towards the first opening;

a second bottom extended to the fourth end of the second closed sidewall, wherein a first space is formed by the first closed sidewall, the first bottom, the second closed sidewall and the second bottom, and a second space is formed by the second closed sidewall and the second bottom; and a one-way gas valve disposed at the second bottom, and connecting the first space with the second space.

2. The portable bubble water bottle defined in claim 1, further comprising: a cover, which is connected to the first end of the first closed sidewall to seal the first space.

3. The portable bubble water bottle defined in claim 1, further comprising: a pedestal, which is connected to the third end of the second closed sidewall to seal the second space.

4. The portable bubble water bottle defined in claim 3, further comprising: a gas bottle, which is connected to a limited component of the pedestal, located at the second space, and a gas outlet of the gas bottle is connected to the one-way gas valve.

5. The portable bubble water bottle defined in claim 1, wherein the volume of the second space is smaller than the volume of the first space.

* * * * *